US008197575B2

(12) United States Patent
Moroney

(10) Patent No.: US 8,197,575 B2
(45) Date of Patent: Jun. 12, 2012

(54) LATERITE HEAP LEACHING WITH FERROUS LIXIVIANTS

(75) Inventor: Adam Sean Moroney, Fern Bay (AU)

(73) Assignee: BHP Billiton SSM Development Pty Ltd. (AU)

( * ) Notice: Subject to any disclaimer, the term of this patent is extended or adjusted under 35 U.S.C. 154(b) by 0 days.

(21) Appl. No.: 12/746,633

(22) PCT Filed: Dec. 24, 2008

(86) PCT No.: PCT/AU2008/001909
§ 371 (c)(1),
(2), (4) Date: Jul. 12, 2010

(87) PCT Pub. No.: WO2009/079716
PCT Pub. Date: Jul. 2, 2009

(65) Prior Publication Data

US 2011/0056332 A1 Mar. 10, 2011

(30) Foreign Application Priority Data

Dec. 24, 2007 (AU) ..... 2007907097

(51) Int. Cl.
*C22B 3/08* (2006.01)

(52) U.S. Cl. ..... 75/743; 423/150.1

(58) Field of Classification Search ..... 75/743; 423/150.1
See application file for complete search history.

(56) References Cited

U.S. PATENT DOCUMENTS

| | | | | |
|---|---|---|---|---|
| 7,871,584 | B2 * | 1/2011 | Liu et al. | 423/150.4 |
| 2009/0148366 | A1 * | 6/2009 | Roche et al. | 423/170 |
| 2010/0282024 | A1 * | 11/2010 | Moroney et al. | 75/743 |

FOREIGN PATENT DOCUMENTS

| | | |
|---|---|---|
| AU | 2006100869 | 11/2006 |
| WO | WO 2005/005671 | 1/2005 |
| WO | WO 2006/029443 | 3/2006 |
| WO | WO 2006/119559 | 11/2006 |
| WO | WO 2007/087675 | 8/2007 |
| WO | WO 2008/022395 | 2/2008 |

* cited by examiner

*Primary Examiner* — George Wyszomierski
*Assistant Examiner* — Tima M McGuthry Banks
(74) *Attorney, Agent, or Firm* — Brinks Hofer Gilson & Lione; G. Peter Nichols

(57) ABSTRACT

A process for heap leaching a laterite that includes providing a primary and a secondary heap, with the primary heap comprising predominantly a nickel and cobalt containing sulfide or saprolitic type ore, and the secondary heap comprising predominantly a nickel and cobalt limonitic type ore; leaching the primary heap with a sulfuric acid solution to generate a solution that includes ferrous ions; and using the solution that includes the ferrous ion as the lixiviant to leach the secondary heap, to produce a pregnant leach solution that includes nickel, cobalt and manganese ions.

2 Claims, 7 Drawing Sheets

LATERITE HEAP LEACHING WITH FERROUS LIXIVIANTS

This application is a national stage entry of PCT/AU2008/001909 filed Dec. 24,2008.

This application claims priority to PCT application Ser. No. PCT/AU2008/001909 filed Dec. 24, 2008 published in English on Jul. 2, 2009 as PCT WO 2009/079716 and to Australian Application No. 2007/907097 filed Dec. 24, 2007, the entire contents of each are incorporated herein by reference.

INTRODUCTION

The present invention relates to a process for the heap leaching of lateritic ore with the use of a ferrous lixiviant. In a preferred embodiment, the ferrous lixiviant is in the form of ferrous ions. A preferred lixiviant is a solution containing ferrous sulfate. In one preferred embodiment, the ferrous ions are is generated through the acid leaching of a nickel containing sulfide or saprolitic ore, which ferrous ions could be used as the lixiviant to leach a predominantly limonitic heap.

BACKGROUND OF THE INVENTION

Laterite ores are potentially the world's largest source of nickel and cobalt. In general, most deposits of nickel/cobalt laterites contain three major zones based on morphology, mineralogy and chemical composition. These three zones, from the base to the surface, atop weathered parent bedrock materials are the saprolite zone, the transition zone and the limonite zone. There is generally a large variation in total thickness of the laterite deposit, as well as individual zone thickness.

The saprolite zone consists predominantly of "saprolitic serpentine" minerals and a large variety of nickel/magnesium silicate minerals. The weathering process, or "serpentinization" of the parent bedrock material is characterised by a decrease in the magnesium content and an increase in the iron content of the top layer of ore body.

The resulting saprolite zone contains between 0.5% and 4% nickel and a higher magnesium content, which is normally over 6% wt. The Co/Ni weight ratio of saprolite is normally less than 1:10.

The transition zone is not normally well defined and is composed essentially of limonite and saprolite. It also commonly contains nickel in the range of from 1.0% to 3.0% with co-existing cobalt ranging from 0.08% up to 1%. Cobalt is generally associated with asbolane, a hydrated manganese oxide.

The limonite zone, located on the top zone of lateritic ore body, contains nickel ranging from about 0.5% to 1.8% and consists of goethite-rich and/or hematite rich ore, which is rich in iron and cobalt. Therefore the cobalt value of a lateritic ore body is mostly recovered from limonitic and transition zone. It has a lower magnesium content than saprolitic type ore. Due to stronger weathering, limonitic ore contains dominantly fine and soft particles of goethite and/or hematite. Sometimes the weathering has not been fully completed and either the hematite or the goethite rich sections are not present. Alternatively, depending upon the climatic condition, the limonite zone will still contain residual iron/aluminium silicates, such as nickel-containing smectite, nontronite and chlorite.

It has been found that the permeability of lateritic ore is largely controlled by the type of mineral occurrence, mineral morphology and particle size. Although the mineralogy of lateritic ore is rather complex and widely variable from deposit to deposit, there is some commonality or similarity of mineral morphology in the worldwide lateritic nickel deposits. These morphological structures enhance permeability of solution and preserve physical stability of individual minerals.

Heap leaching of nickeliferous oxidic ore has been proposed in recovery processes for nickel and cobalt and is described, for example in U.S. Pat. Nos. 5,571,308 and 6,312,500, both in the name of BHP Minerals International Inc.

U.S. Pat. No. 5,571,308 describes a process for heap leaching of high magnesium containing laterite ore such as saprolite. The patent points out that the fine saprolite exhibits poor permeability, and as a solution to this, pelletisation or agglomeration of the ore is necessary to ensure distribution of the leach solution through the heap.

U.S. Pat. No. 6,312,500 also describes a process for heap leaching of laterites to recover nickel, which is particularly effective for ores that have a significant clay component (greater than 10% by weight). This process includes sizing of the ore where necessary, forming pellets by contacting the ore with a lixiviant, and agglomerating. The pellets are formed into a heap and leached with sulfuric acid to extract the metal values. Sulfuric acid fortified seawater may be used as the leach solution.

International application PCT/AU2006/000606 (in the name of BHP Billiton SSM Technology Pty Ltd) also describes a process where nickeliferous oxidic ore is heap leached using an acid supplemented hypersaline water as the lixiviant with a total dissolved solids concentration greater than 30 g/L in order to leach the heap.

Heap leaching laterites offers the promise of a low capital cost process, eliminating the need for expensive and high maintenance, high pressure equipment required for conventional high pressure acid leach processes.

Generally, in a heap leach process of laterites, a relatively strong acidic lixiviant is used to liberate both the cobalt and nickel from the cobalt and nickel containing ores. With laterite ores predominantly consisting of saprolitic type ores, most of cobalt content is associated with hydrated manganese oxides such as asbolane. The nickel is generally associated with saprolitic serpentine minerals and nickel/magnesium silicate minerals. Generally, in heap leaching processes, the lixiviant is a relatively high strength acidic solution that liberates both the nickel and cobalt from the respective minerals within the laterite ore.

It is a desired feature of the present invention to improve the rate and extent recovery of nickel, cobalt and manganese in a heap leach process by leaching a lateritic ore with a lixiviant that includes ferrous ion.

Further, it is a desired feature of the present invention to utilise the ferrous ion, which may be sourced from the heap leaching of saprolitic or sulfidic ores, as a lixiviant in a heap leaching process to recover nickel and other metal values from a limonitic type ore and/or limonitic heap leach residues.

A reference herein to a patent document or other matter which is given as prior art is not to be taken as an admission that that document or matter was known or that the information it contains was part of the common general knowledge as at the priority date of any of the claims.

BRIEF DETAILS OF THE INVENTION

The present invention relates to a heap leach process where the lixiviant is a solution that includes ferrous ions. In one preferred embodiment, the ferrous ions are in the form of ferrous sulfate. The applicants have found that by utilising a lixiviant that includes ferrous ions, that the reductive and/or desorptive nature of the ferrous ion lixiviant is able to provide for an improved recovery rate of nickel extraction, particularly from limonitic type ores and leach residues. The use of a lixiviant that includes ferrous ions is able to target in particular nickel, cobalt and/or manganese containing minerals within a laterite ore, in particular a limonitic type ore.

The ferrous ions may be sourced from any available source such as from the leach liquor of a processing stream where ferrous ions are generated. The lixiviant itself may comprise a solution, such as an acidic solution which includes ferrous ions. Typically, the acidic solution may be a solution that includes ferrous sulfate derived from a processing stream where sulfuric acid has been used. Alternatively, the ferrous ions may be produced in-situ during the leaching of an ore with sulfuric acid.

The ferrous lixiviant may be sourced from the product liquor solution in an integrated leaching process where ferrous ions are generated in a primary leach step. For example, the process may include establishing a primary heap of a nickel containing sulfide or saprolitic ore and leaching the heap with a sulfuric acid solution. The sulfuric acid leaching of such heaps will generate ferrous ions in the form of ferrous sulfate which will report to the resultant product liquor solution, together with leached nickel, cobalt and manganese ions. This product liquor solution including ferrous ions, may be used as the lixiviant to leach a secondary heap of predominantly limonitic type ore.

Accordingly, the present invention resides in a process for heap leaching a laterite ore said process including the steps of:

a) providing a primary and a secondary heap, said primary heap comprising predominantly a nickel and cobalt containing sulfide or saprolitic type ore, and said secondary heap comprising predominantly a nickel and cobalt limonitic type ore;
b) leaching the primary heap with a sulfuric acid solution to generate a solution that includes ferrous ions; and
c) using said solution that includes the ferrous ion as the lixiviant to leach the secondary heap, to produce a pregnant leach solution that includes nickel, cobalt and manganese ions.

The heap may be formed as a primary and secondary heap, or may be combined into a single heap where the limonitic, saprolitic and/or nickel containing sulfide type ores are combined in a single heap. Ferrous ions will be generated in-situ by the addition of sulfuric acid to the heap containing saprolitic and/or sulfide type ores. These ferrous ions can act as the lixiviant in the leaching of nickel, cobalt, manganese and ferric ions from the limonitic component of the ore to form a pregnant leach solution containing nickel, cobalt and manganese ions.

The ferric ions may be precipitated from the pregnant leach solution as ferric containing minerals and disposed as waste solid.

The nickel, cobalt and/or manganese may be recovered from the pregnant leach solution by standard techniques such as sulfide or hydroxide precipitation, ion exchange, solvent extraction or electrowinning.

DETAILED DESCRIPTION OF THE DRAWINGS

The detailed description of the invention will be described with reference to FIGS. 1-7 but it should be kept in mind, that these figures are illustrative of preferred embodiments of the invention, and that the invention should not be considered to be limited thereto.

Figure 1:
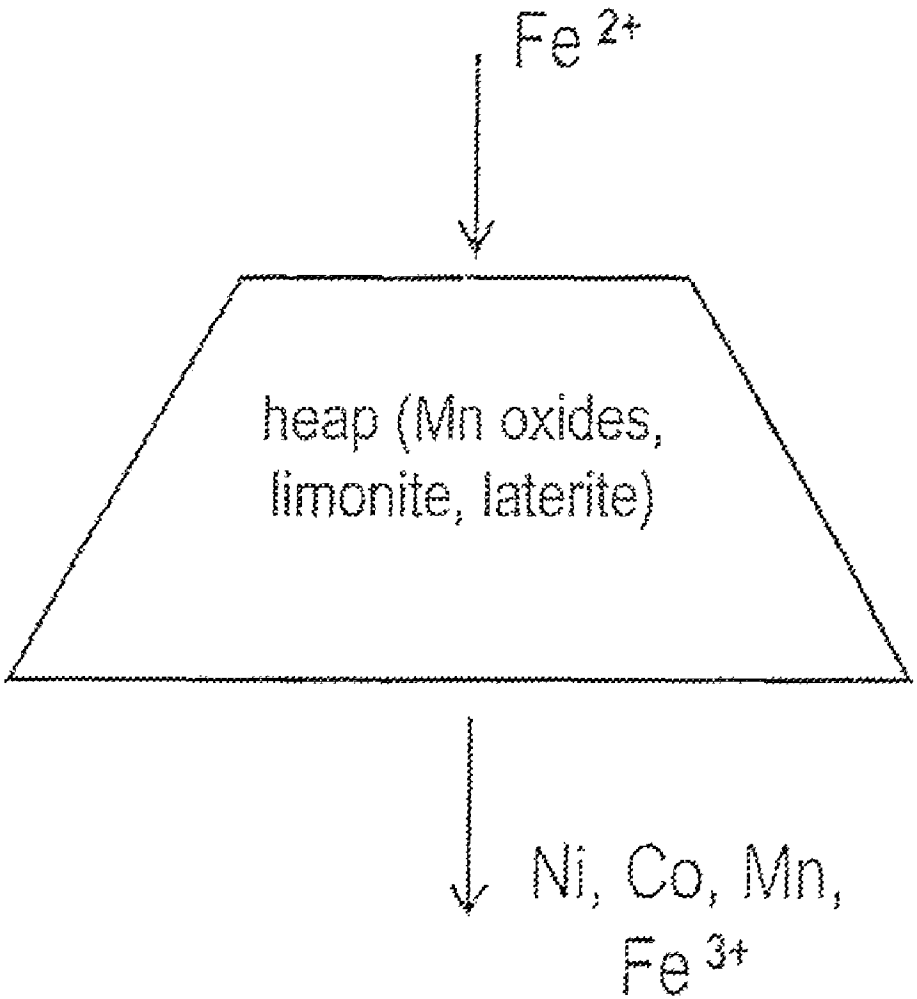
FIG. 1 shows an example of a flowsheet for leaching a heap with a ferrous ion lixiviant.

In FIG. 1, a heap is created which predominantly consists of the limonite fraction of a lateritic ore. Within the limonite fraction, nickel is present within the nickel containing minerals. Cobalt, and to a lesser extent, nickel are also present, generally within cobalt/manganese oxides such as asbolane and other similar cobaltiferous manganese oxyhydroxides such as lithiophorite, hollandite, cryptomelane, psilomelane, pyrolusite and todorokite.

Generally, the ferrous lixiviant may be an acidic solution, generally in the form of a sulfuric acid solution containing ferrous ions. However, following the addition of ferrous ions in the form of ferrous sulfate to a lateritic heap that includes cobalt/manganese minerals such as asbolane, a part if not all of the required acid may be provided in-situ. The reactions are as follows:

$$(Co,Mn)O_2+xH_2SO_4+FeSO_4\rightarrow CoSO_4+MnSO_4+Fe_2(SO_4)_3+xH_2O\ CO_3O_4+2FeSO_4+4H_2SO_4\rightarrow 3CoSO_4+Fe_2(SO_4)_3+4H_2O\ MnO_2+2FeSO_4+2H_2SO_4\rightarrow MnSO_4+Fe_2(SO_4)_3+2H_2O$$
$$Fe_2(SO_4)_3+3H_2O\rightarrow Fe(OH)_3+3H_2SO_4$$

The reactions will also produce ferric sulfate and minor amounts of manganese sulfate together with cobalt sulfate. The ferric sulfate can be caused to precipitate in the heap, as shown, leaving a cobalt and manganese containing pregnant leach solution that is substantially free of iron and other impurities. When the lixiviant contains insufficient acid and ferrous sulfate is used as a reducing agent, the iron will precipitate within the heap as solid ferric containing minerals and may be separated from the cobalt containing pregnant leach solution. Little, if any iron will be leached into the resultant pregnant leach solution. By this means, iron can be removed as a solid waste product, and little, if any iron will be leached into the resultant pregnant leach solution.

Figure 2:
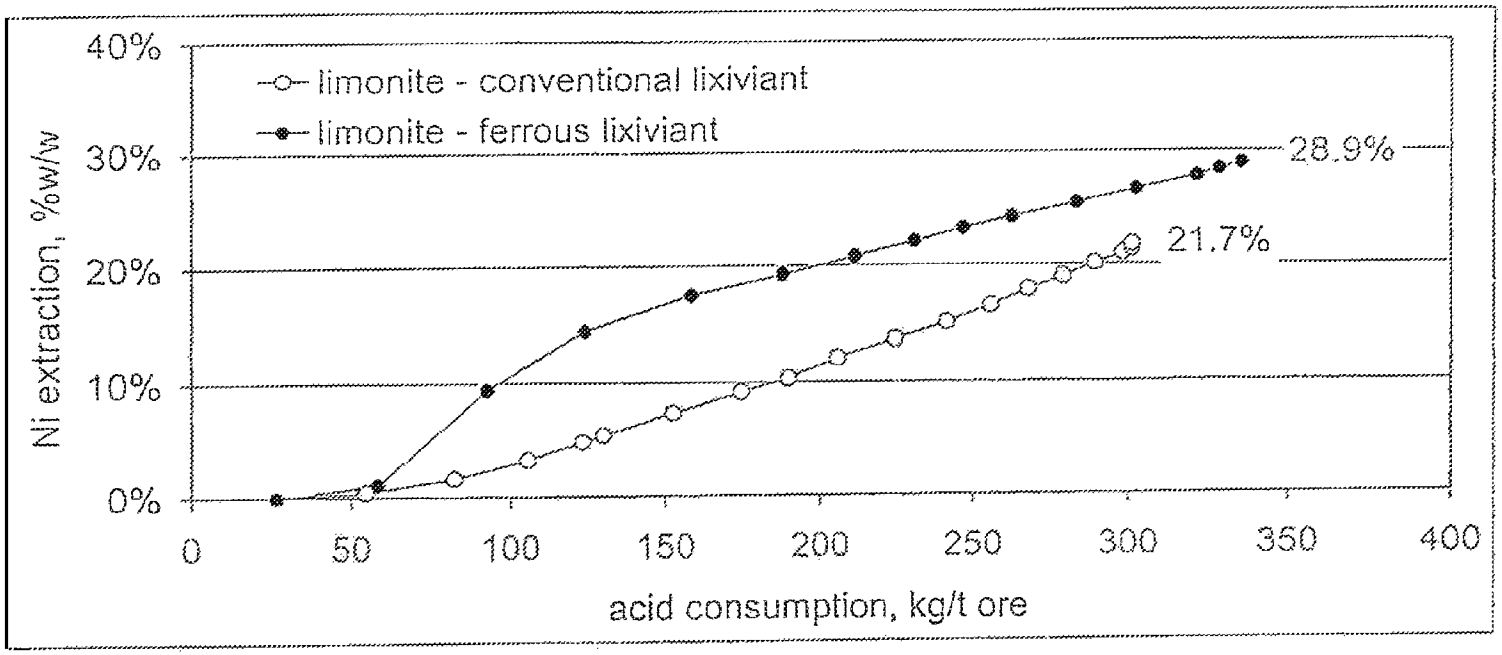
FIG. 2 shows a graph demonstrating the nickel extraction against acid consumption in a heap that is predominantly of limonite with the use of a ferrous lixiviant.
Figure 3:
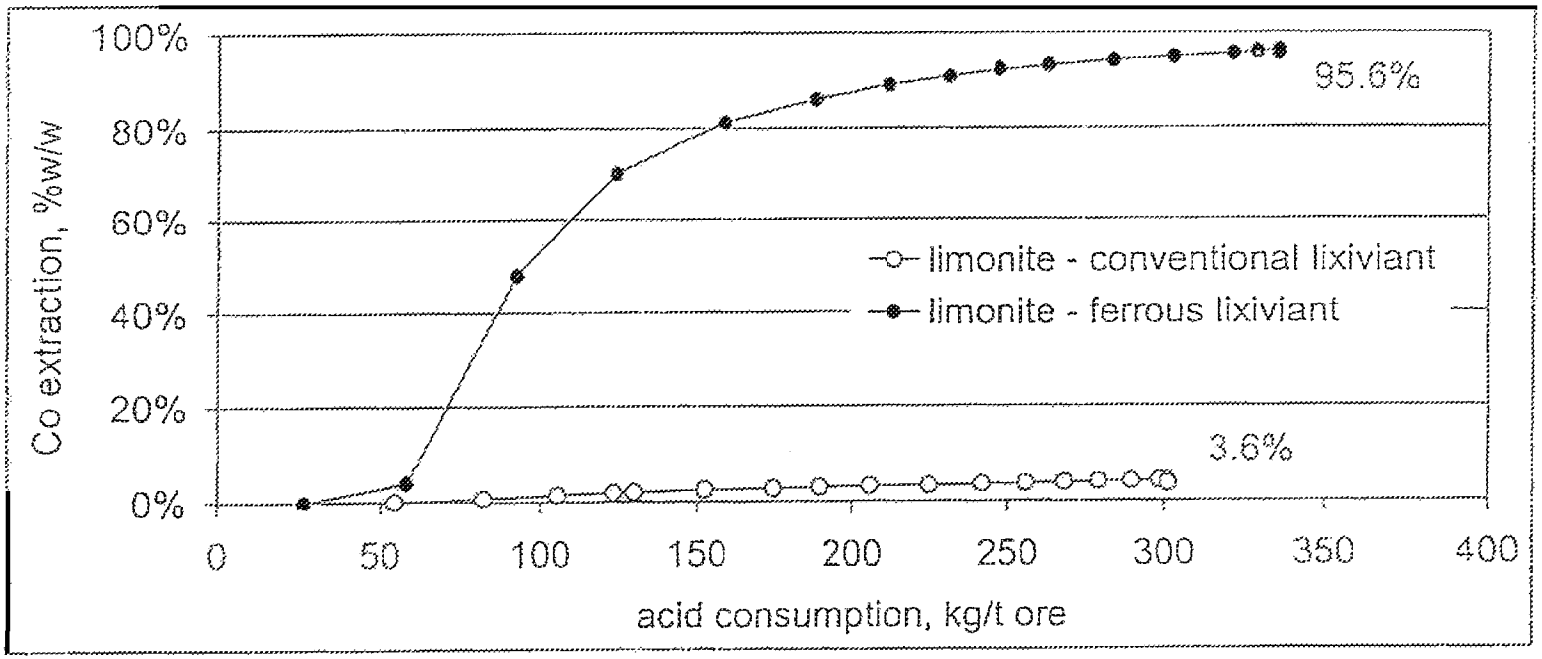
FIGS. 3 and 4 show similar graphs for FIG. 2 but demonstrating cobalt and manganese extraction respectively.
Figure 4:
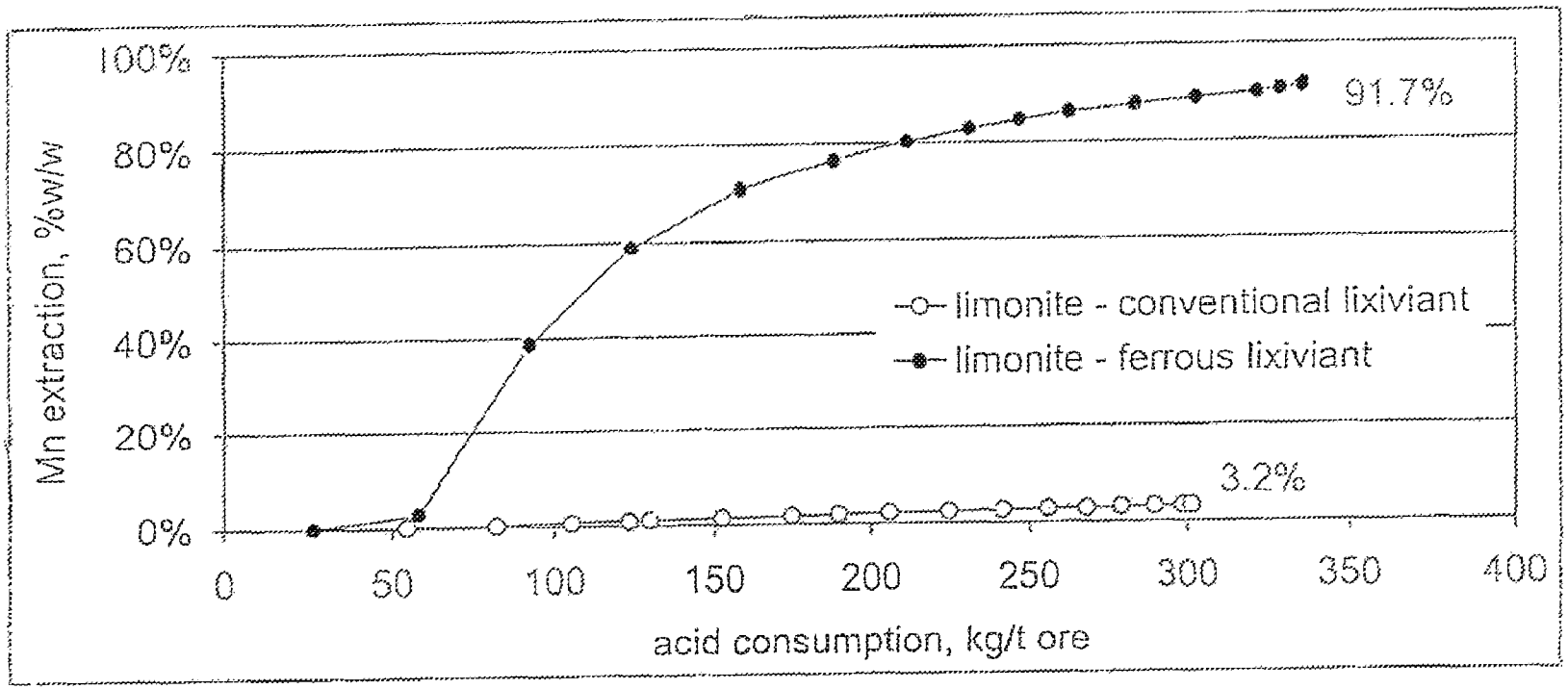

The lixiviant which includes sufficient acid and ferrous ions will leach nickel, cobalt, manganese and ferric ions. FIGS. 2-4 demonstrate that there is improved recovery of nickel with the use of a ferrous lixiviant, compared to a conventional lixiviant in a limonite leach. With respect to cobalt and manganese, there is a recovery of 95% cobalt and 91% manganese, which compares with only about 3% recovery of each element with conventional lixiviants that do not include a ferrous ion.

FIG. 4 illustrates an embodiment where sulfuric acid is first used to leach a heap that is predominantly comprising the saprolitic component of a laterite ore, or a nickel containing sulfide ore, or a combination of both. The leachate will include ferrous ions amongst nickel and other ions that would have been leached through the process. This acidic leachate, including the ferrous ions may be used as the lixiviant to leach a secondary heap which includes the limonitic component of the laterite ore. The resultant pregnant leach solution will include nickel, cobalt, manganese and ferric ions. The recovery of cobalt and manganese will generally be greater than 90% in such processes as illustrated in FIGS. 3 and 4 while there is an increased recovery of nickel, as shown in FIG. 2.

Figure 5:
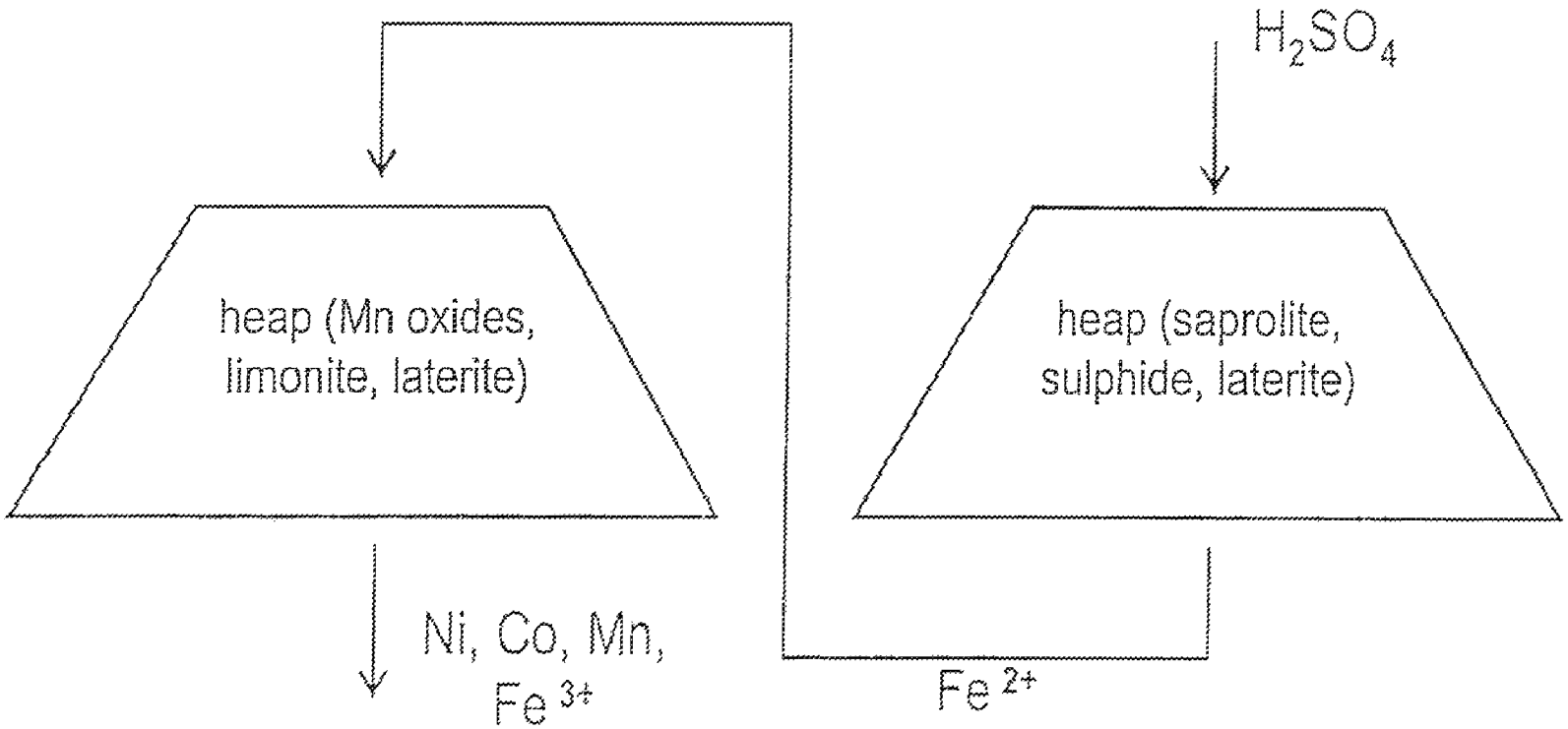
FIG. 5 shows a flowsheet with a primary and secondary heap, the primary heap consisting of saprolite or sulfide type ore, while the secondary heap comprises a limonite type ore.

FIG. 5 illustrates a heap where the limonitic fraction is blended with the saprolitic fraction and/or a nickel containing sulfide ore. Ferrous ions are generated within the heap by the addition of sulfuric acid, together with the saprolitic or sulfide containing nickel ores. In this manner, nickel, cobalt, manganese and ferric ions will be leached.

Figure 6:
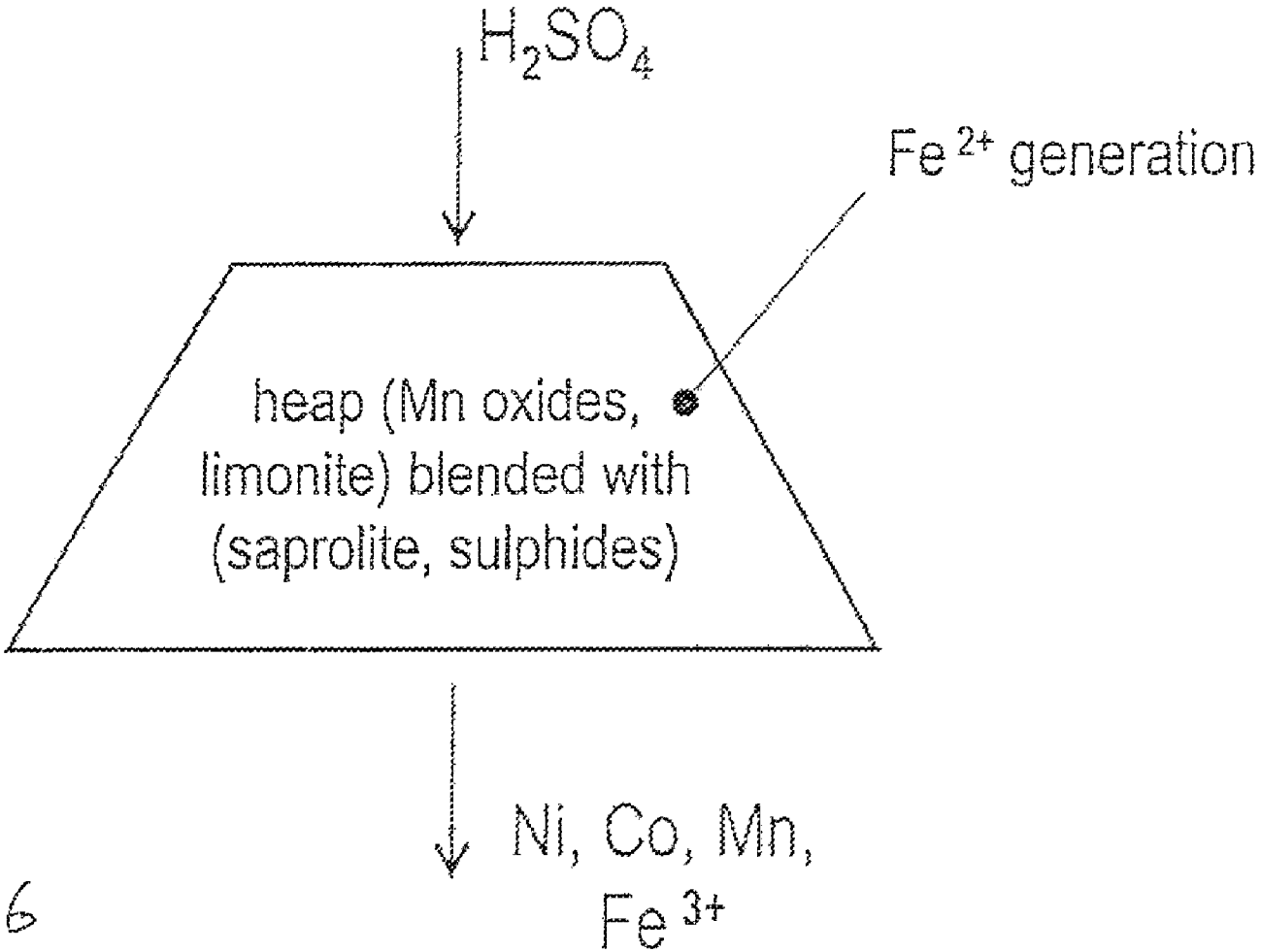
FIGS. 6 and 7 show an example of leaching a heap blended with limonite, saprolite and nickel containing sulfide ore.
Figure 7:
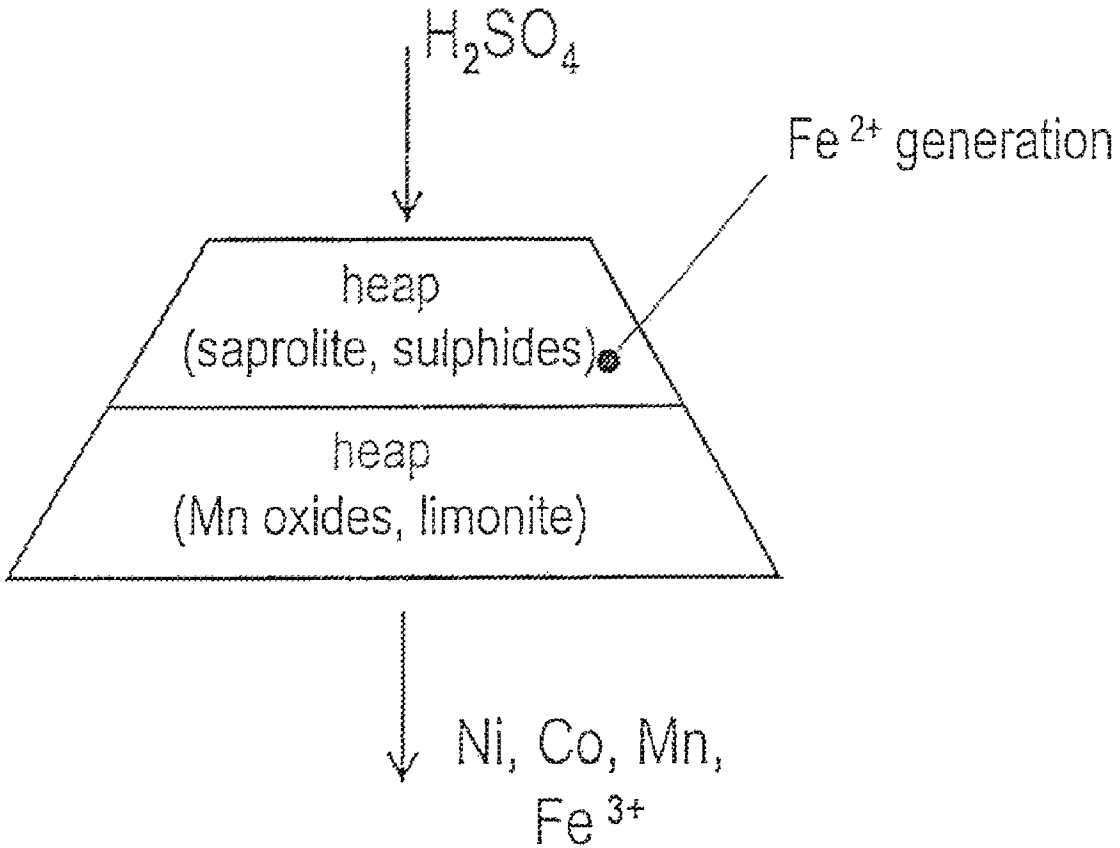

FIG. 6 shows a similar embodiment where ferrous ions are generated by leaching a first heap of saprolitic and/or nickel containing sulfides, which is combined with a heap of limonitic ore.

The present invention provides an increased rate and extent of metal extraction, particularly in relation to nickel, cobalt and manganese.

The invention described herein is susceptible to variations, modifications and/or additions other than those specifically described and it is to be understood that the invention includes all such variations, modifications and/or additions which fall within the spirit and scope of the above description.

The claims defining the invention are as follows:

1. A process for heap leaching a laterite ore said process including the steps of:

a) providing a primary and a secondary heap, said primary heap comprising predominantly a nickel and cobalt containing at least one of a sulfide and saprolitic type ore, and said secondary heap comprising predominantly a nickel and cobalt limonitic type ore;

b) leaching the primary heap with a sulfuric acid solution to generate a solution that includes ferrous ions; and c) using said solution that includes the ferrous ions as the lixiviant to leach the secondary heap, to produce a pregnant leach solution that includes nickel, cobalt and manganese ions.

2. A process according to claim 1 wherein the ferrous ions present as ferrous sulfate.

* * * * *